US007766611B2

(12) United States Patent
Buchal et al.

(10) Patent No.: US 7,766,611 B2
(45) Date of Patent: Aug. 3, 2010

(54) METHOD FOR SETTING A RADIAL GAP OF AN AXIAL-THROUGHFLOW TURBOMACHINE AND COMPRESSOR

(75) Inventors: Tobias Buchal, Düsseldorf (DE); Gerhard Hülsemann, Oberhausen (DE); Mirko Milazar, Oberhausen (DE); Dieter Minninger, Dinslaken (DE); Michael Neubauer, Berlin (DE); Harald Nimptsch, Essen (DE); Heinrich Pütz, Much (DE); Kang Qian, Mülheim an der Ruhr (DE); Arnd Reichert, Mülheim an der Ruhr (DE); Volker Vosberg, Mülheim an der Ruhr (DE)

(73) Assignee: Siemens Aktiengesellschaft, Munich (DE)

( * ) Notice: Subject to any disclaimer, the term of this patent is extended or adjusted under 35 U.S.C. 154(b) by 768 days.

(21) Appl. No.: 11/413,871

(22) Filed: Apr. 28, 2006

(65) Prior Publication Data

US 2006/0245910 A1 Nov. 2, 2006

(30) Foreign Application Priority Data

Apr. 28, 2005 (EP) ..... 05009380

(51) Int. Cl.
*F01D 11/08* (2006.01)

(52) U.S. Cl. ..... 415/173.2; 415/178

(58) Field of Classification Search ..... 415/128, 415/136, 139, 134, 1, 174.2, 173.2, 174.1, 415/175, 176, 177, 178
See application file for complete search history.

(56) References Cited

U.S. PATENT DOCUMENTS

| | | | | |
|---|---|---|---|---|
| 5,344,284 | A * | 9/1994 | Delvaux et al. | 415/173.2 |
| 5,630,702 | A | 5/1997 | Marmilic et al. | |
| 6,602,050 | B1 * | 8/2003 | Scheurlen et al. | 415/173.1 |
| 6,726,448 | B2 * | 4/2004 | McGrath et al. | 415/173.3 |
| 7,229,246 | B2 * | 6/2007 | Ghasripoor et al. | 415/173.3 |
| 2004/0219009 | A1 | 11/2004 | Marchi et al. | |

FOREIGN PATENT DOCUMENTS

| | | | |
|---|---|---|---|
| CN | 1133946 | | 10/1996 |
| DE | 199 38 274 | A1 | 2/2001 |
| EP | 0 559 420 | A1 | 9/1993 |
| EP | 1 163 430 | B1 | 12/2001 |
| GB | 2 397 102 | A | 7/2004 |
| JP | 01150809 | A | 6/1989 |
| JP | 02199202 | A | 8/1990 |
| JP | 05340271 | A | 12/1993 |
| JP | 06159099 | A * | 6/1994 |
| JP | 2000356140 | A | 12/2000 |
| JP | 2003254091 | A | 9/2003 |
| JP | 2004150325 | A | 5/2004 |
| WO | WO 98/55738 | | 12/1998 |
| WO | 2005024186 | A1 | 3/2005 |

* cited by examiner

*Primary Examiner*—Edward Look
*Assistant Examiner*—Dwayne J White

(57) ABSTRACT

The invention relates a method for improving the hot-starting behavior of a turbomachine. By virtue of the setting of a radial gap formed between a brushing edge of a blade profile and a guide face lying opposite this, in which setting a guide ring forming the guide face can be acted upon with a coolant, the hot-starting behavior can be improved, in that the guide ring is cooled before the start of the machine.

4 Claims, 2 Drawing Sheets

METHOD FOR SETTING A RADIAL GAP OF AN AXIAL-THROUGHFLOW TURBOMACHINE AND COMPRESSOR

CROSS REFERENCE TO RELATED APPLICATIONS

This application claims priority to and benefit of European Patent application No. 05009380.6 filed Apr. 28, 2005 and is incorporated by reference herein in its entirety.

FIELD OF THE INVENTION

The invention relates to a method for setting a radial gap, formed between a brushing edge of a blade profile and a guide face lying opposite this brushing edge, of an axial-through-flow turbomachine in which a guide ring forming the guide face can be acted upon with a coolant. The invention relates, furthermore, to a compressor.

BACKGROUND OF THE INVENTION

The laid-open publication DE 199 38 274 A1 discloses, in this respect, a method and a device for the controlled setting of the radial gap between stator and rotor arrangements in a gas turbine. The design-related radial gaps are formed between the rotatable moving blades of the rotor of the turbomachine and the guide faces lying opposite them fixedly in terms of rotation on the stator. The guide faces serve for guiding the working medium and are formed by annular segments which are subdivided in the circumferential direction and extend coaxially as a guide ring about the axis of rotation of the rotor in the axial direction. When the gas turbine is in operation, the moving blades of the rotor move at a distance from the guide faces. Conversely, free-standing guide blades can also in each case form a radial gap with respect to a rotating conical or cylindrical guide face arranged on the rotor. In order further to optimize the efficiency of the gas turbine, the radial gaps are to be designed so as to be as small as possible. It is known from the abovementioned laid-open publication to fasten guide rings to a stator by means of holding partners arranged obliquely with respect to the radial direction and, during the operation of the gas turbine, to displace this stator in the direction of the moving blade ends by virtue of the thermal expansion of the material of the guide ring, in order to make the radial gap smaller.

Something similar is disclosed in EP 1 163 430 B1. During the operation of a gas turbine, a guide element lying opposite a tip of a turbine moving blade flexes in the direction of the moving blade tip on account of the thermal expansions, thereby making the radial gaps smaller. At the same time, the guide element can be acted upon with cooling air from the rear side, so that it can withstand the temperatures prevailing in the flow duct.

Moreover, it is known from GB 2 397 102 A to insulate the guide ring of a turbine with respect to the carrying structure.

It is known, furthermore, that the design parameters determining the gap dimension are designed for the hot starting of a gas turbine, in order to satisfy the requirements for the smallest possible operating gap, that is to say radial gap. After the gas turbine has been run down, the casing cools comparatively quickly, as compared with the rotor of the gas turbine. The casing or the guide rings, on account of their cooling, shrink back to their original design size, the still hot rotor initially remaining expanded due to the heat stored in it and cooling and shrinking with a delay. This gives rise to what is known as the contraction effect. This situation may result in the radial gap decreasing as the blades of the rotor touching or even brushing against the casing or the guide ring, thus permanently enlarging the radial gap or possibly even damaging the blade. An enlarged radial gap leads to increased fuel consumption, and damaged blades may make it necessary to carry out premature maintenance with the corresponding extra costs.

During the starting, that is to say run-up, of the gas turbine, the centrifugal forces acting on the moving blades bring about a further expansion of these, which may close the radial gap still present before the starting of the gas turbine and cause a harmful and unwanted brushing against of the blades.

SUMMARY OF THE INVENTION

The object of the present invention is to specify a method of the type initially mentioned which improves the hot-starting behavior of the turbomachine in order to increase availability, and at the same time to increase the efficiency. Moreover, the object of the invention is to specify a compressor for this purpose.

The object aimed at the method is achieved by means of the features of the claims and the object aimed at the compressor is achieved by means of the features of the claims.

The solution proposes that the guide ring be acted upon by coolant before the starting of the turbomachine. The invention in this case proceeds from the knowledge that the hot-starting conditions of the turbomachine are improved by the radial gap being influenced, in that, in the case of a still hot or heated-up turbomachine which, however, is not in operation, the gap dimension of the radial gaps is enlarged by means of the proposed method, as compared with the gap dimension of the radial gap of a gas turbine known from the prior art, in the identical state. The guide ring, having a hammer-shaped cross section, is formed over the circumference by annular segments lying against one another. Since the guide ring lying opposite the moving blades (or the guide blades) is fixed radially further outward (or inward), action upon it by coolant leads to a displacement of the guide faces which is directed away from the opposite brushing edges of the blades. The enlargement of the radial gaps which is thus achieved results in the reduction in the contraction effect described and in the risk of brushing, thus significantly improving the hot-starting behavior of the turbomachine, that is to say the turbomachine could be started earlier with respect to its previous rundown time point. Moreover, the radial gaps no longer need to be dimensioned according to the hot start as an unfavorable operating start.

The cooling of the hot guide rings enlarges the radial gaps of the inoperative turbomachine. The radial gap enlargement obtained for this state may also be utilized partially, instead for improving the hot start, in order to design the radial gaps of the turbomachine which is in the inoperative and cold state, say at ambient temperature, so as to be smaller, with respect to a turbomachine known from the prior art.

This has an advantageous effect on the operation, in particular on the stationary operation of the turbomachine, particularly in the case of a compressor and in the case of a turbine unit. In this operating state, the method according to the invention is no longer applied, so that the radial gaps become smaller again. During operation, the reduction in size of the design-related radial gaps mitigates, so as to increase efficiency, the losses in the working medium which arise due to the unused leakage flow through the radial gap, particularly in the case of increasing pressure conditions of the working medium in the flow duct.

Advantageous embodiments are specified in the dependent patent claims.

After the (hot) start of the turbomachine, both the rotor and the casing of the turbomachine heat up, as the operating period continues, to a maximum operating temperature. In this case, both the casing and the rotor expand, so that there is no longer the risk of contraction. Accordingly, the method is particularly advantageous when action upon the guide ring by coolant is stopped during the starting of the turbomachine. After the maximum operating temperature is reached, the thermally induced expansions of the turbomachine, that is to say the stator and the rotor, are concluded. The guide ring consequently also heats up, so that the latter expands and displaces its guide face in the direction of the brushing edges of the blades, thus leading to an efficiency-increasing reduction in size of the radial gaps. This may be employed advantageously particularly when the turbomachine is designed as a compressor of a gas turbine, in which the guide rings are normally uncooled during operation.

It is particularly advantageous if the coolant is extracted from an external coolant source. Conventionally, in a turbomachine designed as a gas turbine, coolant in the form of cooling air is extracted from the compressor. Since the method is employed even before the starting of the gas turbine, this is not possible. An external coolant source, for example a separately driven auxiliary compressor or external blower, therefore has to be used for providing the coolant for cooling the guide rings before the hot start of the gas turbine.

Preferably, after the start of the turbomachine, the guide ring can be acted upon by heating medium. This is advantageous particularly when the turbomachine is, for example, a compressor or a turbine of a gas turbine, and when the methods known from the prior art, in which material expansions of the guide ring are used to set the radial gap, are applied to the guide ring of a compressor. Air or steam may preferably be used as heating medium. By the guide ring being heated, its guide face grows toward the brushing edge of the blades and thus reduces the size of the radial gap enclosed by them.

BRIEF DESCRIPTION OF THE DRAWINGS

The invention is explained by means of a drawing in which.

DETAILED DESCRIPTION OF THE INVENTION

Figure 1:
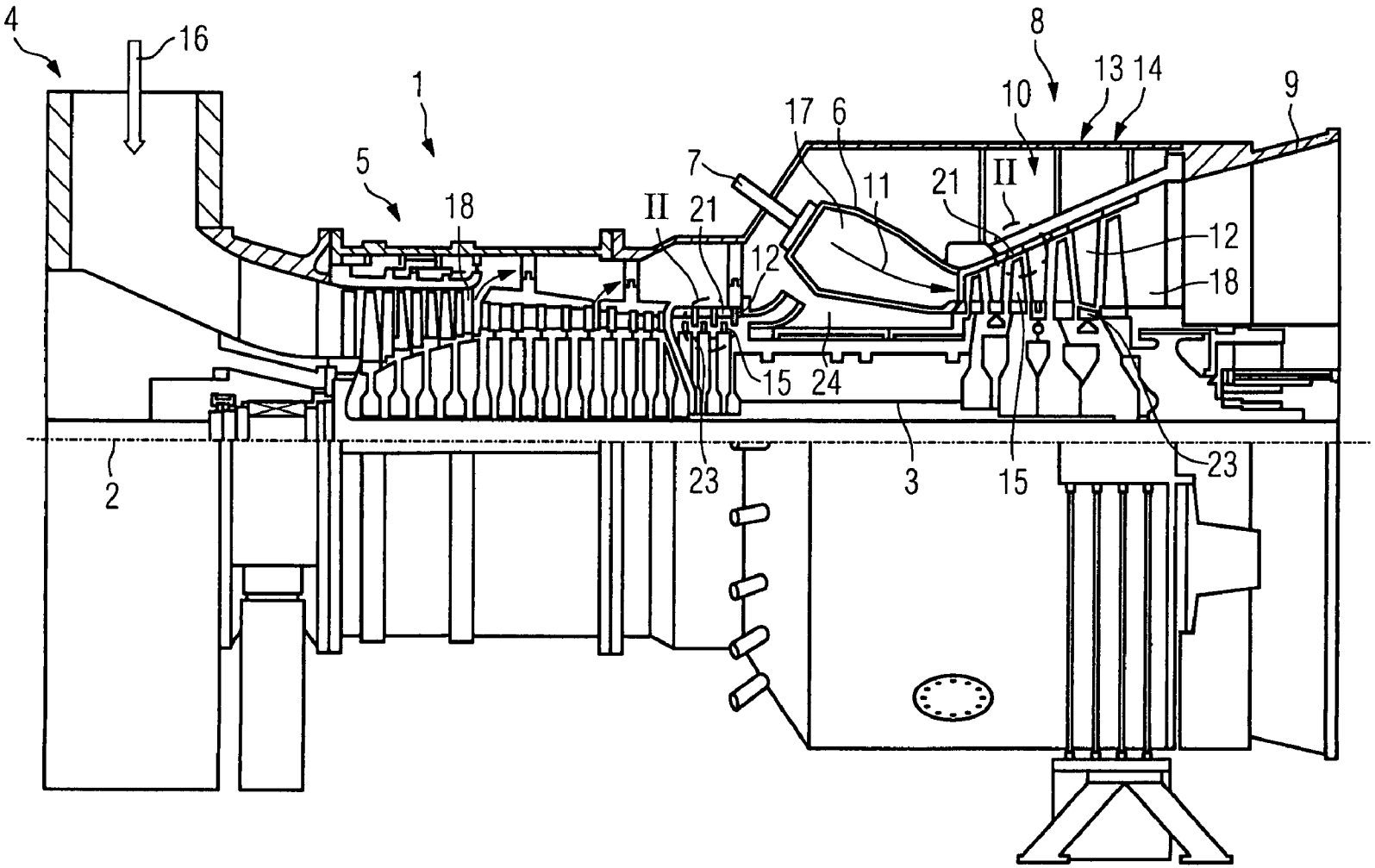
FIG. 1 shows a longitudinal part section through a turbomachine designed as a gas turbine, with a compressor and a turbine unit.

FIG. 1 shows, as an example of a turbomachine, a longitudinal part section through a gas turbine 1. It has, inside it, a rotor 3 which is rotationally mounted about an axis of rotation 2 and which is also designated at the turbine rotor. A suction-intake casing 4, a compressor 5, a toroidal annular combustion chamber 6 with a plurality of coaxially arranged burners 7, a turbine unit 8 and the exhaust gas casing 9 succeed one another along the rotor 3. The annular combustion chamber 6 forms a combustion space 17 which communicates with an annular flow duct 18. There, four turbine stages 10 connected in series form the turbine unit 8. Each turbine stage 10 and each compressor stage is formed from two blade rings.

In the turbine unit 8, as seen in the flow direction of a hot gas 11, a guide blade row 13 is followed in the flow duct 18 by a row 14 formed from moving blades 15. The guide blades 12 are in this case fastened to the stator, whereas the moving blades 15 of a row 14 are mounted on the rotor 3 by means of a turbine disk. A generator or a working machine is coupled (not illustrated) to the rotor 3.

By contrast, in the compressor 5, a compressor stage is formed by a moving blade row 13 with a ring of guide blades 12 which follows in the flow direction of the air to be compressed.

A guide ring 21 lies radially opposite the moving blade 15 on the outside and a guide ring 23 lies radially opposite the guide blade 12 on the inside. The guide rings 21, 23 delimit in the radial direction the flow duct 18 extending in the axial direction of the rotor 3. The guide rings 21, 23 may be formed from annular segments lying one against the other over the circumference.

After the starting of the gas turbine 1 and as a result of the working medium flowing in the flow duct 18, all the components of the gas turbine 1 heat up. On account of the temperature rise, these components, that is to say also the rotor 3, the moving blade 15, the guide blades 12 and the inner casing 27, expand with respect to their cold state.

When the gas turbine 1 is heated up completely and a no longer varying temperature distribution is established, all the thermally induced expansions are also concluded. The gas turbine 1 is then in a stationary state.

Figure 2:
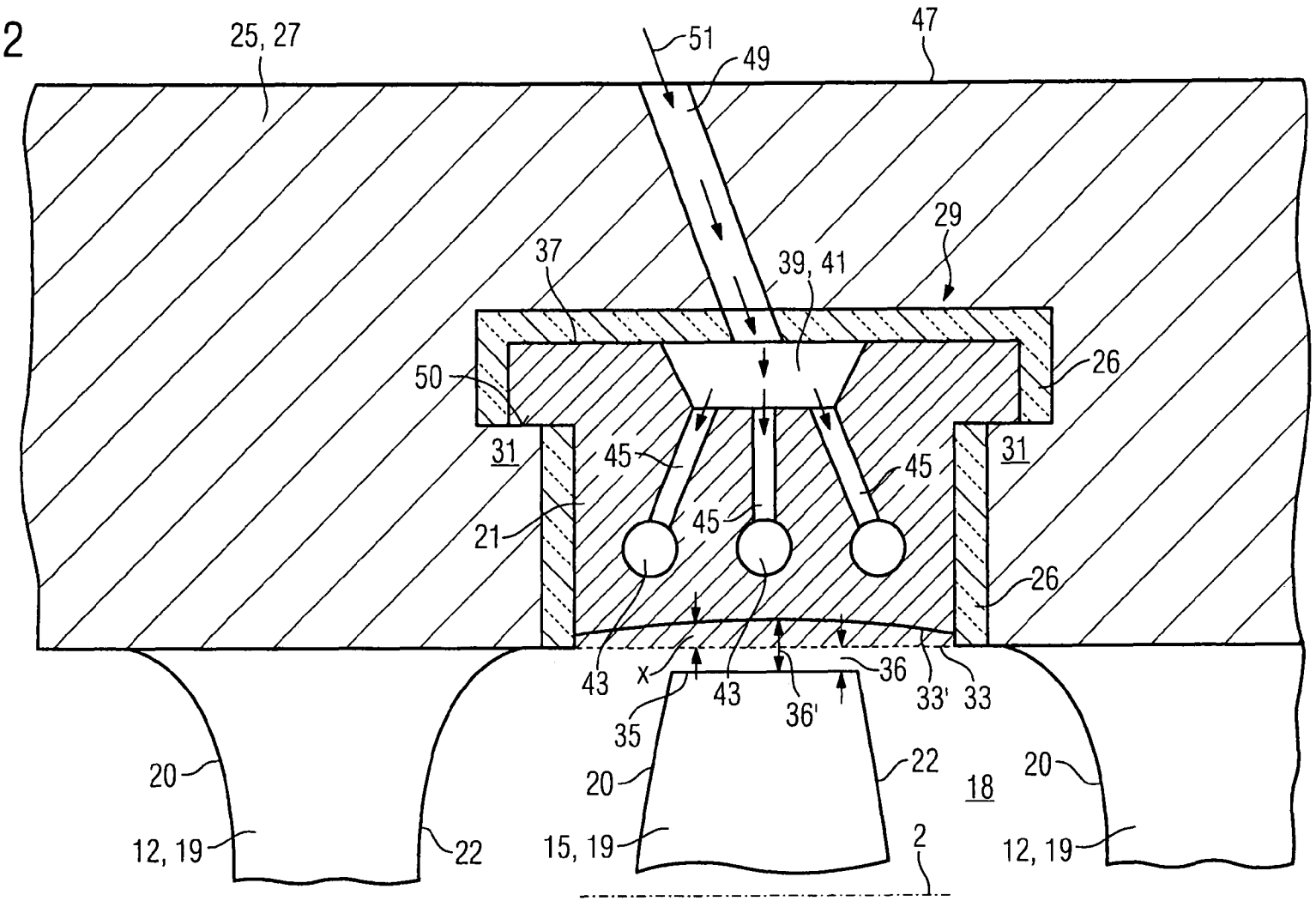
FIG. 2 shows the detail II of FIG. 1, a guide ring in cross section with an opposite blade tip.

FIG. 2 shows the detail II from FIG. 1, a cross section through a guide ring 21 with an opposite blade, after all the thermally induced expansions are concluded. In this case, the device shown in FIG. 2 may be provided both in the turbine unit 8 and/or in the compressor 5 of the gas turbine 1.

The blades each have a blade profile 19 of drop-shaped cross section which has a leading edge 20 capable of having a working medium flowing onto it and a trailing edge 22.

A wall 25 extending cylindrically or conically with respect to the axis of rotation 2 of the gas turbine rotor 3 forms part of a rotationally fixed inner casing 27. The wall 25 surrounds the annular flow duct 18. The inner casing 27 or the wall 25 has incorporated in it a groove 29 of hammer-shaped cross section which runs in the circumferential direction and in which the guide ring 21 is arranged. The guide ring 21 thus also surrounds the flow duct 18 coaxially with respect to the axis of rotation 2 of the rotor 3.

Between the wall 25 and the guide ring 21, an insulating layer 26 may be formed, which shields and insulates the guide ring 21 thermally with respect to the wall 25, so that the wall 25 or the inner casing 27 does not likewise shrink in the direction of the blade.

The guide ring 21 is in this case manufactured from a material which expands under the action of heat, that is to say a temperature rise, preferably in this case expands to a greater extent than the wall 25 or the inner casing 27, that is to say the guide ring 21 has a higher coefficient of thermal expansion than the wall 25 or the inner casing 27.

The guide ring 21 is designed so as to match essentially with the hammer-shaped groove 29 and bears on the rear side directly, or, as illustrated via the insulating layer 26, against the groove bottom of the groove 29 and on the front side against a bearing face 50 of the undercut 31, so that the guide ring 21 is fixed. The bearing face 50 determines the radial position of the guide ring 21 and is in this case arranged radially further outward (or inward) than the guide face 33 lying opposite the tips of the moving blade 15 (or guide blades 12).

The moving blade 15, in particular its brushing edge 35, lies opposite the guide face 33, facing the flow duct 18, of the guide ring 21. A radial gap 36 is formed between the brushing edge 35 of each moving blade 15 and the guide face 33. When the gas turbine is in operation, the moving blade 15 rotates under and below the face 33, this being indicated for clarity by the axis of rotation 2 shown in a position which is not true to scale.

That face 37 of the guide ring 21 which is on the rear side with respect to the guide face 33 has incorporated in it a groove 39 which forms with the wall 25 or, if present, with the insulating layer 26 a circumferentially running, that is to say annular supply duct 41.

Furthermore, a plurality of, preferably three cooling ducts 43 extend in the circumferential direction, that is to say coaxially with respect to the axis of rotation 2, and communicate with the supply duct 41 via radial connecting ducts 45.

A feed duct 49, which opens into the supply duct 41, extends through the wall 25 from that side 47 of the latter which faces away from the flow duct 18.

After the gas turbine 1 has been shut down, the casing cools more quickly than the rotor 3, so that the expansions of the casing decrease or diminish more quickly and contract the still hot rotor 3 which is therefore expanded to a greater extent. The gap dimension of the radial gap 36 is thereby reduced.

In the event of an early start of the still hot gas turbine 1, that is to say during a hot start, the centrifugal forces acting on the rotor 3 and the moving blades 15 cause an additional radial growth, which may reduce the size of the radial gap 36 in such a way that the brushing edges 35 may brush harmfully against the guide face 33.

This is where the invention comes in. Before the operation of the still hot gas turbine is resumed, the supply duct 41 is fed by the feed duct 49 with coolant 51 which passes from there via the connecting ducts 45 into the cooling ducts 43 and cools the guide ring 21. The coolant 51 absorbs the heat still stored in the guide ring 21 and subsequently, via orifices, not shown, is either blown out into the flow duct 18 or recirculated outward from the machine interior via recirculation ducts, likewise not illustrated. By heat which is, in particular, is near the guide face being transported away from the guide ring 21, the thermal induced material expansions of the guide ring 21 diminish. In conjunction with its local position defined radially on the outside in the groove 29, the guide face 33 delimiting the flow duct 16 is displaced radially outward into the position 33'. As a result of this, the radial gap 36 is enlarged by the amount of the distance X to 36', with the result that the risk of the moving blades 15 brushing against the guide face 33 or 33' in the event of the hot start decreases. This effect may be utilized in order to shorten the duration between the rundown or shutdown and the hot start of the gas turbine.

The method is particularly effective when the guide ring 21 is insulated with respect to the wall 25. In this embodiment, only the guide ring 21 is cooled, not also the wall 25. This leads to a particularly efficient cooling of the guide ring 21 and prevents the wall 25 from likewise being co-moved in an identical way. This ensures that only the guide ring 21 reduces its thermally induced expansions.

After or during the start, that is to say during the process of starting up the gas turbine 1, the casing heats up and expands. The casing and also the inner casing 27 are displaced radially outward. The risk of the moving blades 15 brushing with their brushing edge 35 against the guide face 33 of the guide rings 21 is reduced, so that, after a predetermined operating period, the cooling of the guide rings 21 can be stopped.

At the same time, the gas turbine 1 heats up further, until a no longer varying temperature distribution is established in it.

Insofar as the material of the guide ring 21 allows a further temperature rise, the heating medium may even be conducted through the ducts 49, 41, 45, instead of the coolant 51, during the operation of the gas turbine 1. A further temperature rise in the guide ring 21 causes an additional expansion in the radial direction, as a result of which the radial gap 36 is further reduced. This leads to an increase in efficiency, since less working medium—in the compressor 5, the gas to be compressed and, in the turbine unit 8, the expanding hot gas 11—can escape, unused, through the reduced radial gap 36.

The radial gap 36 may not only be formed between a radially outer guide face 33 and a moving blade 15, but it may also lie between the rotationally fixed guide blade 12 and the guide face 23 arranged on the rotor 3. Accordingly, the wall 25 can be part of the rotor 3, so that a guide blade 12 lies opposite the guide ring 23. In this case, the displacement directions also change from the outside inward.

The method according to the invention for varying the radial gaps 36 is suitable particularly for compressors 5. However, it may also be used in the turbine unit 8.

The invention claimed is:

1. A device for varying a radial gap of a compressor blade tip and a stationary component of an axial-flow compressor, comprising:

a carrying structure; and a guide ring supported by the carrying structure, the guide ring having a surface arranged radially opposite of the blade tip, wherein a coolant cools the guide ring, wherein the guide ring is thermally insulated from the carrying structure, and wherein the guide ring has a higher coefficient of thermal expansion than the carrying structure.

2. The device as claimed in claim 1, wherein the carrying structure has a bearing surface that the guide ring contacts, and the bearing face is arranged radially further outward or inward than the surface arranged opposite the blade tip.

3. An axial flow gas turbine engine, comprising:

a rotationally mounted rotor arranged coaxially with a longitudinal centerline of the engine;

a rotor blade fixed to the rotor, having a tip radially opposed to a centerline of the rotor;

an inlet casing that intakes a working fluid arranged coaxially with the rotor;

an axial flow compressor that receives the working fluid and provides a compressed working fluid, the compressor having:

a stationary carrying structure, and a guide ring supported by the carrying structure, wherein the guide ring has a surface radially opposite of the blade tip, wherein a coolant cools the guide ring to adjust a radial distance between the blade tip and the guide ring surface;

a toroidal annular combustion chamber that receives the compressed working fluid and combusts a fuel to provide a hot working medium; and a turbine that expands the hot working medium to produce mechanical energy, wherein the guide ring is thermally insulated from the carrying structure, and wherein the guide ring has a higher coefficient of thermal expansion than the carrying structure.

4. The engine as claimed in claim 3, wherein the carrying structure has a bearing surface that the guide ring contacts, and the bearing face is arranged radially further outward or inward than the surface arranged opposite the blade tip.

* * * * *